US009980065B2

(12) United States Patent
Higgins et al.

(10) Patent No.: US 9,980,065 B2
(45) **Date of Patent: *May 22, 2018**

(54) BALL AND SOCKET CONNECTION WITH AN ACOUSTIC SEAL AND MOUNTING INTERFACE FOR A HEARING ASSISTANCE DEVICE

(71) Applicant: Starkey Laboratories, Inc., Eden Prairie, MN (US)

(72) Inventors: Sidney A. Higgins, Maple Grove, MN (US); Wei Li Lin, Plymouth, MN (US); David Tourtelotte, Eden Prairie, MN (US)

(73) Assignee: Starkey Laboratories, Inc., Eden Prairie, MN (US)

( * ) Notice: Subject to any disclaimer, the term of this patent is extended or adjusted under 35 U.S.C. 154(b) by 0 days. days.

This patent is subject to a terminal disclaimer.

(21) Appl. No.: 14/730,474

(22) Filed: Jun. 4, 2015

(65) Prior Publication Data

US 2015/0271611 A1 Sep. 24, 2015

Related U.S. Application Data

(63) Continuation of application No. 13/408,826, filed on Feb. 29, 2012, now Pat. No. 9,071,918.

(Continued)

(51) Int. Cl.

| | |
|---|---|
| ***H04R 25/00*** | (2006.01) |
| ***H04R 1/02*** | (2006.01) |
| *H04R 1/10* | (2006.01) |

(52) U.S. Cl.

CPC ..... *H04R 25/65* (2013.01); *H04R 1/025* (2013.01); *H04R 25/60* (2013.01); *H04R 1/1016* (2013.01);

(Continued)

(58) Field of Classification Search

USPC ..... 381/322

See application file for complete search history.

(56) References Cited

U.S. PATENT DOCUMENTS

| | | | | |
|---|---|---|---|---|
| 3,431,370 | A | 3/1969 | Crosby | |
| 4,135,517 | A * | 1/1979 | Reale | A61F 2/36 606/86 R |

(Continued)

FOREIGN PATENT DOCUMENTS

| | | | |
|---|---|---|---|
| CH | 648172 | A5 | 2/1985 |
| EP | 2501159 | A2 | 9/2012 |
| WO | WO-0003561 | A1 | 1/2000 |

OTHER PUBLICATIONS

"U.S. Appl. No. 13/404,496, Final Office Action dated Oct. 30, 2015", 18 pgs.

(Continued)

*Primary Examiner* — Amir Etesam

(74) *Attorney, Agent, or Firm* — Schwegman Lundberg & Woessner, P.A.

(57) ABSTRACT

Disclosed herein, among other things, are apparatus and methods to provide improved connections for components of hearing assistance devices. Various embodiments include an apparatus including a receiver case configured to house a hearing assistance device receiver, the receiver case including a spherical receiver spout having an opening. The apparatus also includes a receptacle housing having a spherical socket adapted to mate with the spherical receiver spout to form a ball and socket connection. An insert within the spherical socket is configured to establish a retained interference fit with the opening of the receiver spout when the connection is formed so as to create an acoustic seal therebetween.

20 Claims, 6 Drawing Sheets

Related U.S. Application Data

(60) Provisional application No. 61/454,346, filed on Mar. 18, 2011.

(52) U.S. Cl.
CPC ..... *H04R 25/652* (2013.01); *Y10T 29/49572* (2015.01)

(56) References Cited

U.S. PATENT DOCUMENTS

| | | | | |
|---|---|---|---|---|
| 4,879,750 | A | 11/1989 | Nassler | |
| 4,972,488 | A | 11/1990 | Weiss et al. | |
| 4,987,597 | A | 1/1991 | Haertl | |
| 5,864,628 | A | 1/1999 | Posen et al. | |
| 6,212,283 | B1 * | 4/2001 | Fletcher | H04R 25/456 381/313 |
| 6,310,961 | B1 | 10/2001 | Oliveira et al. | |
| 6,671,381 | B1 | 12/2003 | Lux-Wellenhof | |
| 7,401,679 | B2 | 7/2008 | Ipsen | |
| 7,773,764 | B2 | 8/2010 | Niederdrank | |
| 7,983,434 | B2 | 7/2011 | Röhrlein | |
| 8,416,974 | B2 | 4/2013 | Ammitzboll et al. | |
| 9,071,918 | B2 | 6/2015 | Higgins et al. | |
| 9,369,816 | B2 | 6/2016 | Yoong et al. | |
| 2007/0142697 | A1 * | 6/2007 | Schneider | H04R 25/606 600/25 |
| 2009/0154747 | A1 | 6/2009 | Vestergaard et al. | |
| 2009/0202097 | A1 | 8/2009 | Tiscareno et al. | |
| 2012/0219167 | A1 | 8/2012 | Yoong et al. | |
| 2012/0237065 | A1 | 9/2012 | Higgins et al. | |
| 2015/0382118 | A1 | 12/2015 | Vaishya | |

OTHER PUBLICATIONS

"U.S. Appl. No. 13/404,496, Non Final Office Action dated Jun. 23, 2015", 18 pgs.
"U.S. Appl. No. 13/404,496, Response filed Oct. 22, 2015 to Non Final Office Action dated Jun. 23, 2015", 9 pgs.
"U.S. Appl. No. 13/404,496, Advisory Action dated Jan. 28, 2014", 3 pgs.
"U.S. Appl. No. 13/404,496, Advisory Action dated May 13, 2015", 3 pgs.
"U.S. Appl. No. 13/404,496, Advisory Action dated Aug. 20, 2014", 2 pgs.
"U.S. Appl. No. 13/404,496, Examiner Interview Summary dated Aug. 21, 2014", 2 pgs.
"U.S. Appl. No. 13/404,496, Final Office Action dated Jun. 3, 2014", 16 pgs.
"U.S. Appl. No. 13/404,496, Final Office Action dated Oct. 29, 2013", 14 pgs.
"U.S. Appl. No. 13/404,496, Final Office Action dated Dec. 31, 2014", 17 pgs.
"U.S. Appl. No. 13/404,496, Non Final Office Action dated Feb. 13, 2014", 16 pgs.
"U.S. Appl. No. 13/404,496, Non Final Office Action dated Apr. 16, 2013", 11 pgs.
"U.S. Appl. No. 13/404,496, Non Final Office Action dated Sep. 18, 2014", 17 pgs.
"U.S. Appl. No. 13/404,496, Preliminary Amendment dated May 14, 2012", 3 pgs.
"U.S. Appl. No. 13/404,496, Response filed Jan. 29, 2014 to Advisory Action dated Jan. 28, 2014", 7 pgs.
"U.S. Appl. No. 13/404,496, Response filed Apr. 30, 2015 to Final Office Action dated Dec. 31, 2014", 10 pgs.
"U.S. Appl. No. 13/404,496, Response filed May 13, 2014 to Non Final Office Action dated Feb. 13, 2014", 8 pgs.
"U.S. Appl. No. 13/404,496, Response filed Jul. 16, 2013 to Non Final Office Action dated Apr. 16, 2013", 8 pgs.
"U.S. Appl. No. 13/404,496, Response filed Aug. 4, 2014 to Final Office Action dated Jun. 3, 2014", 8 pgs.
"U.S. Appl. No. 13/404,496, Response filed Sep. 3, 2014 to Advisory Action dated Aug. 20, 2014", 8 pgs.
"U.S. Appl. No. 13/404,496, Response filed Dec. 18, 2014 to Non Final Office Action dated Sep. 8, 2014", 9 pgs.
"U.S. Appl. No. 13/404,496, Response filed Dec. 30, 2013 to Final Office Action dated Oct. 29, 2013", 8 pgs.
"U.S. Appl. No. 13/408,826, Advisory Action dated Jan. 15, 2015", 3 pgs.
"U.S. Appl. No. 13/408,826, Advisory Action dated Dec. 20, 2013", 2 pgs.
"U.S. Appl. No. 13/408,826, Final Office Action dated Sep. 18, 2013", 11 pgs.
"U.S. Appl. No. 13/408,826, Final Office Action dated Nov. 5, 2014", 11 pgs.
"U.S. Appl. No. 13/408,826, Non Final Office Action dated Apr. 25, 2014", 11 pgs.
"U.S. Appl. No. 13/408,826, Non Final Office Action dated May 28, 13", 10 pgs.
"U.S. Appl. No. 13/408,826, Notice of Allowance dated Feb. 27, 2015", 8 pgs.
"U.S. Appl. No. 13/408,826, Response filed Jan. 5, 2015 to Final Office Action dated Nov. 5, 2014", 9 pgs.
"U.S. Appl. No. 13/408,826, Response filed Jul. 22, 2014 to Non Final Office Action dated Apr. 25, 2014", 9 pgs.
"U.S. Appl. No. 13/408,826, Response filed Aug. 29, 2013 to Non Final Office Action dated May 28, 2013", 9 pgs.
"U.S. Appl. No. 13/408,826, Response filed Nov. 18, 2013 to Final Office Action dated Sep. 18, 2013", 9 pgs.
"European Application Serial No. 12156939.6, Extended European Search Report dated Feb. 11, 2014", 7 pgs.
"European Application Serial No. 12156939.6, Extended Search Report Response filed Aug. 20, 2014 to Extended Search Report dated Feb. 11, 2014", 18 pgs.
Boersma, Paul, "Accurate Short-Term Analysis of the Fundamental Frequency and the Harmonics-to-Noise Ratio of a Sampled Sound", Institute of Phonetic Sciences, University of Amsterdam, Proceedings 17, (1993), 97-110.
Chou, Wen-Sheng, et al., "A binaural algorithm for space and pitch detection", 2011 IEEE International Conference on Acoustics, Speech and Signal Processing (ICASSP), (2011), 4976-4979.
Mitre, Adriano, et al., "Accurate and Efficient Fundamental Frequency Determination from Precise Partial Estimates", Proceedings of the 4th AES Brazil Conference, (2006), 113-118.
Noll, A. Michael, "Pitch Determination of Human Speech by the Harmonic Product Spectrum, the Harmonic Sum Spectrum and a Maximum Likelihood Estimate", Proceedings of the Symposium on Computer Processing in Communications, vol. XIX, Polytechnic Press: Brooklyn, New York, (1970), 779-797.
"U.S. Appl. No. 13/404,496, Notice of Allowance dated Feb. 9, 2016", 7 pgs.
"U.S. Appl. No. 13/404,496, Response filed Jan. 29, 2016 to Final Office Action dated Oct. 30, 2015", 10 pgs.
"European Application Serial No. 12160013.4, Extended European Search Report dated Oct. 4, 2016", 9 pgs.

* cited by examiner

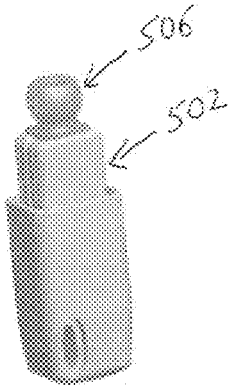
FIG. 5A
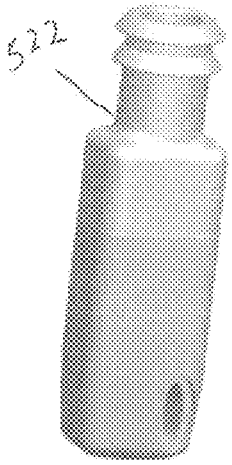
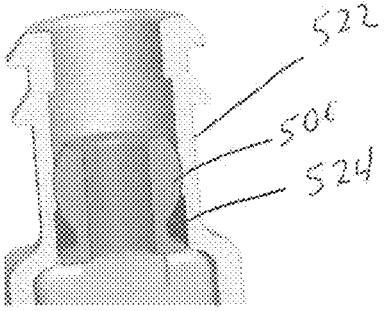
FIG. 5B FIG. 5C
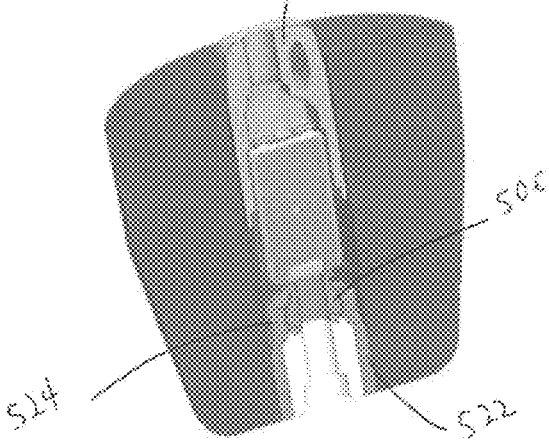
FIG. 5D

BALL AND SOCKET CONNECTION WITH AN ACOUSTIC SEAL AND MOUNTING INTERFACE FOR A HEARING ASSISTANCE DEVICE

CLAIM OF PRIORITY AND INCORPORATION BY REFERENCE

The present application is a continuation of U.S. patent application Ser. No. 13/408,826, filed on Feb. 29, 2012, which application claims the benefit of U.S. Provisional Application No. 61/454,346, filed Mar. 18, 2011, which application are hereby incorporated by reference in their entirety.

FIELD OF THE INVENTION

The present subject matter relates generally to hearing assistance devices and in particular to a ball and socket connection for a hearing assistance device.

BACKGROUND

Hearing assistance devices, such as hearing aids, typically include a housing or shell with internal components such as a signal processor, a microphone and a receiver housed in a receiver case. The housing or shell of a hearing assistance device has a size limitation based on the application. Specifically, devices that include an in-the-ear portion have housings that are constrained by the geometry of the inner ear of the wearer. Constraints for the device housing or shell generally include a relatively small size, sharp bends and a rounded shape.

Receiver cases currently have a cylindrical receiver spout that connects to other components or receptacles of a hearing assistance device. Once engaged, the cylindrical receiver spout does not allow significant movement of the receiver case with respect to the other components, such as a sound tube. Improper fit can cause feedback and it can be difficult to obtain a proper acoustical seal between the receiver case and other components. In addition, connections to industry standard ear canal buds and wax protection devices can be challenging based on these constraints.

Accordingly, there is a need in the art for apparatus and methods to provide improved connections for components of hearing assistance devices.

SUMMARY

Disclosed herein, among other things, are apparatus and methods to provide improved connections for components of hearing assistance devices. Various embodiments include an apparatus including a receiver case configured to house a hearing assistance device receiver, the receiver case including a spherical receiver spout having an opening. The apparatus also includes a receptacle housing having a spherical socket adapted to mate with the spherical receiver spout to form a ball and socket connection. An insert within the spherical socket is configured to establish a retained interference fit with the opening of the receiver spout when the connection is formed so as to create an acoustic seal therebetween.

Various embodiments include a method of making a hearing assistance device connector with an acoustical seal. A receiver case is provided to house a hearing assistance device receiver, the receiver case including a spherical receiver spout, the spherical receiver spout including an opening having a radially concave contour. A receptacle housing is provided including a spherical socket adapted to mate with the spherical receiver spout to form a ball and socket connection. A convex insert is provided within the spherical socket, the convex insert configured to establish a retained interference fit with the concave opening of the receiver spout when the connection is formed so as to create an acoustic seal therebetween.

In various embodiments, a hearing assistance device includes a housing having a receiver case and a sound tube within the housing. The receiver case includes a spherical receiver spout, and the sound tube is adapted to mate with the spherical receiver spout to form a ball and socket connection. After the receiver spout is mated with the sound tube, the receiver case is configured to be oriented at a desired angle with respect to the sound tube to conform to an inner surface of the housing, in various embodiments.

This Summary is an overview of some of the teachings of the present application and not intended to be an exclusive or exhaustive treatment of the present subject matter. Further details about the present subject matter are found in the detailed description and appended claims. The scope of the present invention is defined by the appended claims and their legal equivalents.

BRIEF DESCRIPTION OF THE DRAWINGS

FIGS. 5A-5D illustrate an apparatus having a housing and connector for use with a hearing assistance device, according to various embodiments of the present subject matter.

DETAILED DESCRIPTION

Figure 1:
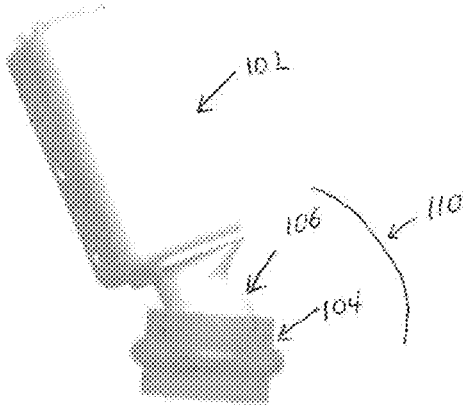
FIG. 1 illustrates a receiver case and sound tube for a hearing assistance device, according to one embodiment of the present subject matter.

The following detailed description of the present subject matter refers to subject matter in the accompanying drawings which show, by way of illustration, specific aspects and embodiments in which the present subject matter may be practiced. These embodiments are described in sufficient detail to enable those skilled in the art to practice the present subject matter. References to "an", "one", or "various" embodiments in this disclosure are not necessarily to the same embodiment, and such references contemplate more than one embodiment. The following detailed description is demonstrative and not to be taken in a limiting sense. The scope of the present subject matter is defined by the appended claims, along with the full scope of legal equivalents to which such claims are entitled.

The present detailed description will discuss hearing assistance devices using the example of hearing aids. Hearing aids are only one type of hearing assistance device. Other hearing assistance devices include, but are not limited to, those in this document. It is understood that their use in the description is intended to demonstrate the present subject matter, but not in a limited or exclusive or exhaustive sense.

Hearing assistance device receivers in an ear canal may include a receiver encased in either a stock injection molded housing or affixed to a custom cast ear canal impression. Ear buds and or wax protection systems can be applied to the distal end of these housings. In cases where ball and socket designs currently are used there may be insufficiencies in either design or real-estate to incorporate an acoustic seal. The present subject matter uses a ball and socket as a mounting feature to maintain a sealing element in various applications. In various embodiments, the present subject matter is used in custom assembly applications, such as custom fit devices. In various embodiments, the present subject matter is used in standard fit devices. In various embodiments, the present subject matter is used to retain a mounting sleeve that allows the use of replaceable industry standard ear buds and wax protection devices. In various embodiments, the present subject matter provides a means for blind quick connect and disconnect, among other things.

The present subject matter includes embodiments providing a ball and socket coupling for a hearing assistance device with an in-situ acoustic seal and mounting interface. Various embodiments include a method of making a hearing assistance device connector with an acoustical seal. In various embodiments, a receiver case is provided to house a hearing assistance device receiver, the receiver case including a spherical receiver spout, the spherical receiver spout including an opening having a radially concave contour. In various embodiments, a receptacle housing is provided that includes a spherical socket adapted to mate with the spherical receiver spout to form a ball and socket connection. In various embodiments a convex insert is provided within the spherical socket, the convex insert configured to establish a retained interference fit with the concave opening of the receiver spout when the connection is formed so as to create an acoustic seal therebetween. The ball and socket with insert includes a tight acoustic seal, in various embodiments. The convex insert and concave opening afford variations in angular alignment of the ball and socket while maintaining the acoustic seal. In various embodiments, the ball and socket coupling is for quick connection and disconnection inside a single hearing assistance device module (ear mold) or receiver-in-the-canal (RIC) receiver housing. In one embodiment, no wires pass through the connection. The convex insert is bonded within the spherical socket, in an embodiment. In another embodiment, the convex insert is molded within the spherical socket. The portion of the opening including the radially concave contour can be referred to as a lip, in various embodiments. The shape of the lip permits higher gain receivers in custom applications, according to various embodiments.

In various embodiments, a ball receiver spout and a socket receptacle is provided for a custom hearing assistance device with a built in elastomeric seal. This allows for replacement of the cable/receiver assembly with reuse of the custom shell, in various embodiments. In some applications it affords fitting options in hearing assistance device shells that are too small for existing solutions by elimination of unnecessary wall sections and allows greater flexibility in off axis insertions. In standard or non-custom applications, an embodiment includes a stock housing that provides for a onetime assembly to the ball socket. In this configuration, the housing serves as a mounting point for traditional wax protection devices and ear canal buds. In various embodiments, a spout that can accept a wax barrier or wax guard such as a waxceptor can be used with the present subject matter. In other embodiments, a nano-coated spout with built-in wax protection can be used with the present subject matter, such as the built-in wax protection coating disclosed in commonly-owned U.S. patent application Ser. No. 13/404,496, entitled OMNIPHOBIC PERFORATED BARRIER FOR HEARING AID TRANSDUCERS, which is hereby incorporated by reference it its entirety.

Figure 3A:
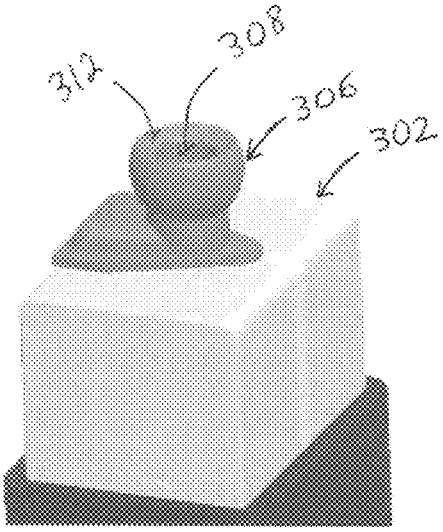
FIGS. 3A-3C illustrate an apparatus including an acoustically sealed connector for use with a hearing assistance device, according to various embodiments of the present subject matter.
Figure 3B:
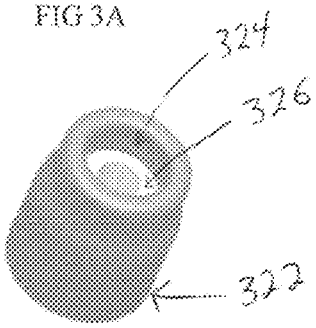
Figure 3C:
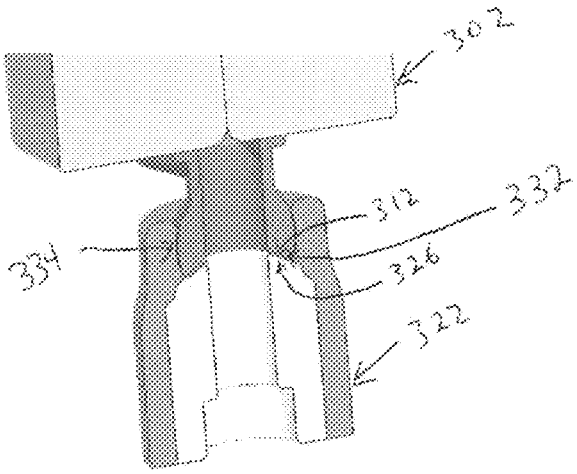

FIGS. 3A-3C illustrate apparatus including an acoustically sealed connector for use with a hearing assistance device, according to various embodiments of the present subject matter. FIG. 3A illustrates an apparatus including a receiver case 302 configured to house a hearing assistance device receiver, the receiver case including a spherical receiver spout 306. The spherical receiver spout 306 includes an opening 308 having a radially concave contour 312 to provide an interface seal. FIG. 3B illustrates that the apparatus also includes a receptacle housing 322 having a spherical socket 324 adapted to mate with the spherical receiver spout to form a ball and socket connection. A convex insert 326 within the spherical socket 324 is configured to establish a retained interference fit with the concave opening of the receiver spout when the connection is formed so as to create an acoustic seal therebetween, as shown in FIG. 3C. The convex insert 326 includes an elastomeric component or substrate, in various embodiments. A retention feature 334 holds the spherical receiver spout contoured opening 312 against the convex insert 326 at a seal interface 332, in various embodiments. The ball and socket with insert includes a tight acoustic seal, in various embodiments. The convex insert and concave opening afford variations in angular alignment of the ball and socket while maintaining the acoustic seal.

In various embodiments, the receptacle housing 322 includes a polymer housing. In various embodiments, the polymer housing reinforces the receiver/spout assembly and provides a biocompatibility barrier. The receptacle housing is configured to include an interface for elastomeric ear buds and/or a wax protection device, in various embodiments. In various embodiments, the convex insert is an elastomeric component adapted to be molded or bonded inside the receptacle housing. In various embodiments, the insert includes a liquid injection molded (LIM) insert. The socket provides a stock snap receptacle that includes the LIM insert to allow replacement of the receiver/cable assembly and reuse of a custom ear mold, in various embodiments. The spherical receiver spout and the spherical socket are configured to provide for connection and disconnection at various degrees of on and off vertical axial alignment, in various embodiments.

Figure 4A:
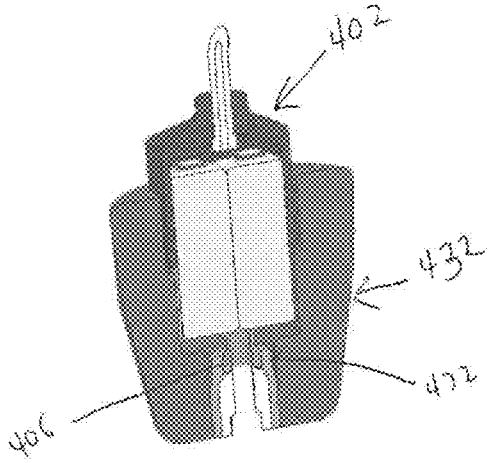
FIGS. 4A-4C illustrate an apparatus including a ball and socket connection for use with a hearing assistance device, according to various embodiments of the present subject matter.
Figure 4B:
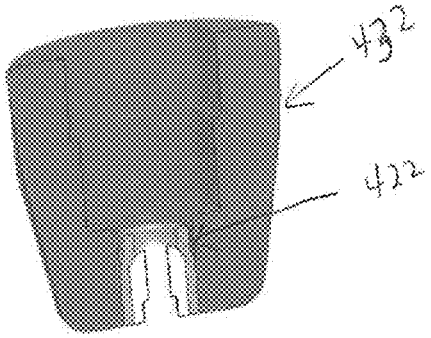
Figure 4C:
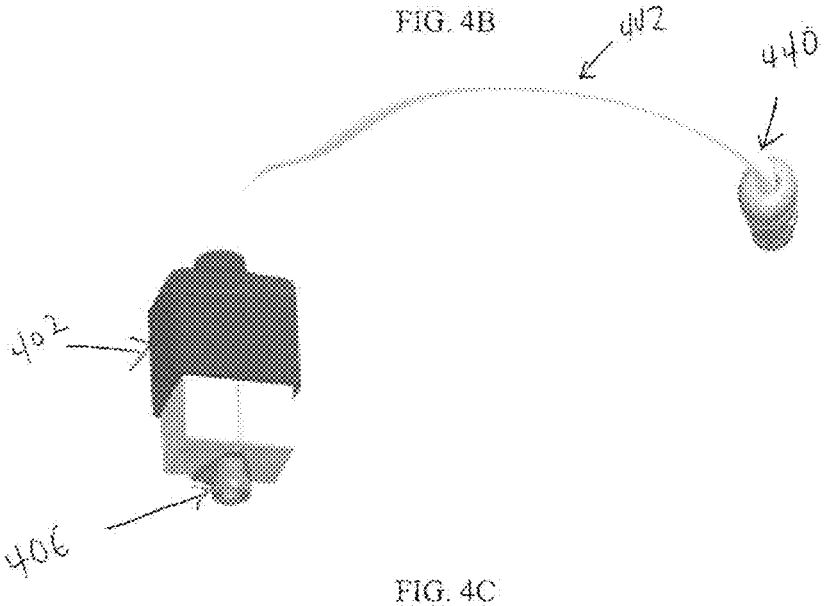

FIGS. 4A-4C illustrate an apparatus including a ball and socket connection for use with a hearing assistance device, according to various embodiments of the present subject matter. FIG. 4C illustrates a case 402 including a spherical spout 406. In the depicted embodiment, the case 402 is connected via a cable 442 to an accessory 440, such as an ear bud or wax protection device. FIG. 4B illustrates a housing 432 having spherical socket 422. In FIG. 4A, the case and housing are mated, thus connecting the spout 406 with the socket 422. In one embodiment, the spout and socket include the spout and socket of FIGS. 3A-3C. This sealing ball and socket design allows for replacement of one component assembly while preserving the seal of the other assembly, in various embodiments. The ball and socket includes a tight acoustic seal, in various embodiments. The convex insert and concave opening afford variations in angular alignment of the ball and socket while maintaining the acoustic seal.

FIGS. 5A-5D illustrate an apparatus having a housing and connector for use with a hearing assistance device, according to various embodiments of the present subject matter. FIG. 5A illustrates a receiver assembly 502 (cable connector not shown) having a spherical spout 506, such as spout 306 in FIG. 3A. FIGS. 5B-5C illustrate the interface between the spherical spout 506 connected to a socket 524 inside housing 522. Depending on the application, a front housing could be applied or inserted into a custom cast hearing assistance device shell, in various embodiments. The ball and socket includes a tight acoustic seal, in various embodiments. The convex insert and concave opening afford variations in angular alignment of the ball and socket while maintaining the acoustic seal.

Figure 6:
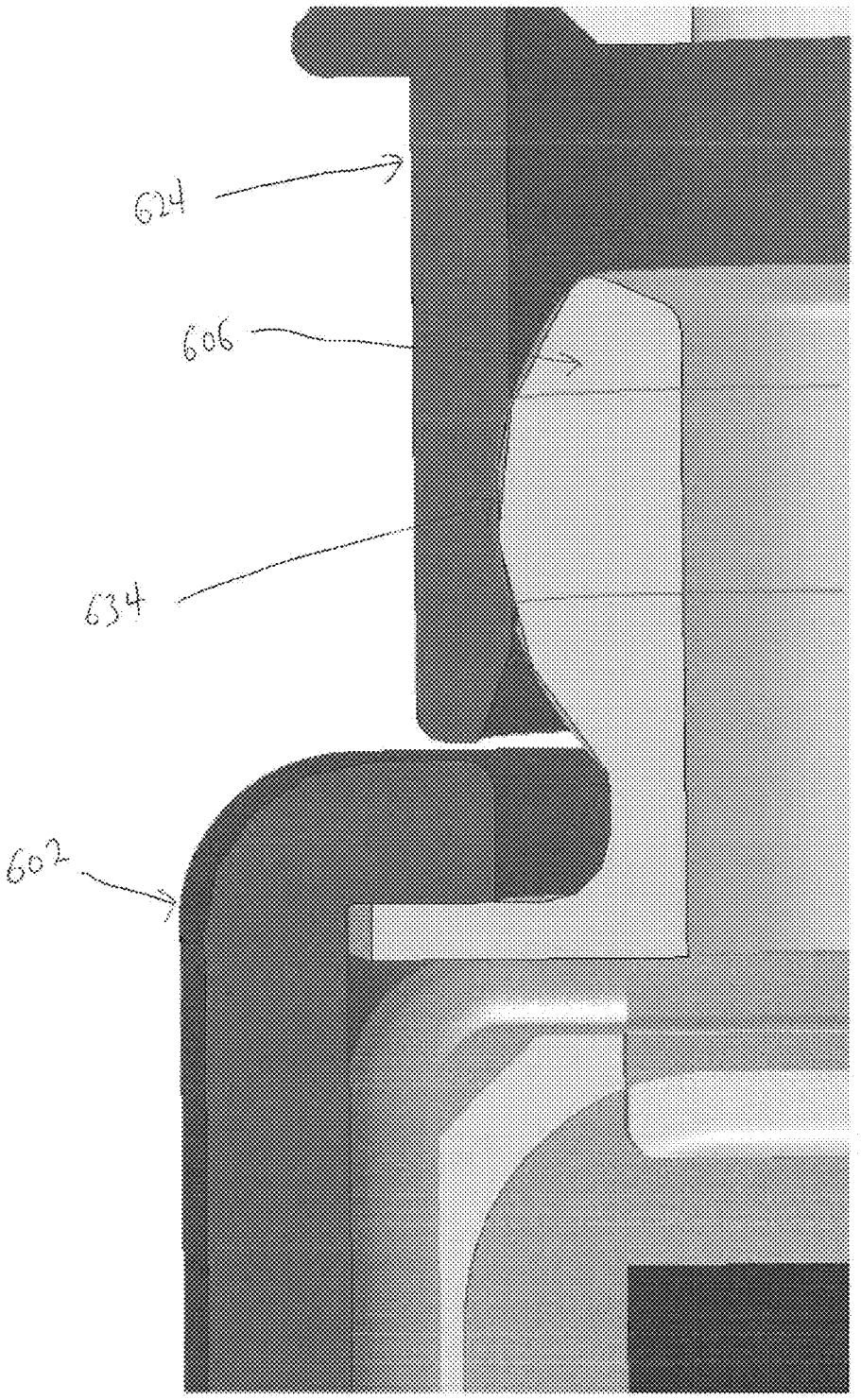
FIG. 6 illustrates an apparatus including a ball and socket snap spout for a hearing assistance device, according to various embodiments of the present subject matter.

FIG. 6 illustrates an apparatus including a ball and socket snap spout for a hearing assistance device, according to various embodiments of the present subject matter. A close-up of the ball 606 and socket 624 interface is shown for a stock application, according to an embodiment. The ball 606 is connected to a receiver case, in various embodiments. According to various embodiments, the socket 624 includes a retention feature 634. By adjusting the degree of undercut of the retention feature 634, the retention forces can be adjusted and "dialed-in" to use the connection as a one-time snap (increased retention force) or as a replaceable or multiple snap connection (decreased retention force), in various embodiments. In one embodiment, the acoustic seal includes a 1 psi seal with a 0.002 interference fit, which exceeds the maximum decibel level for an acoustic fit for a hearing assistance device receiver. In addition, the present subject matter is configured to provide for a reduced amount of necessary force to connect the ball and socket, while retaining a higher amount of necessary force to disconnect the ball and socket, thus providing ease of use and stability of connection in various embodiments. In one embodiment, the ball and socket uses less than six Newtons of force for a snap-fit connection, while requiring nearly ten Newtons of force to disconnect the ball and socket.

Figure 7:
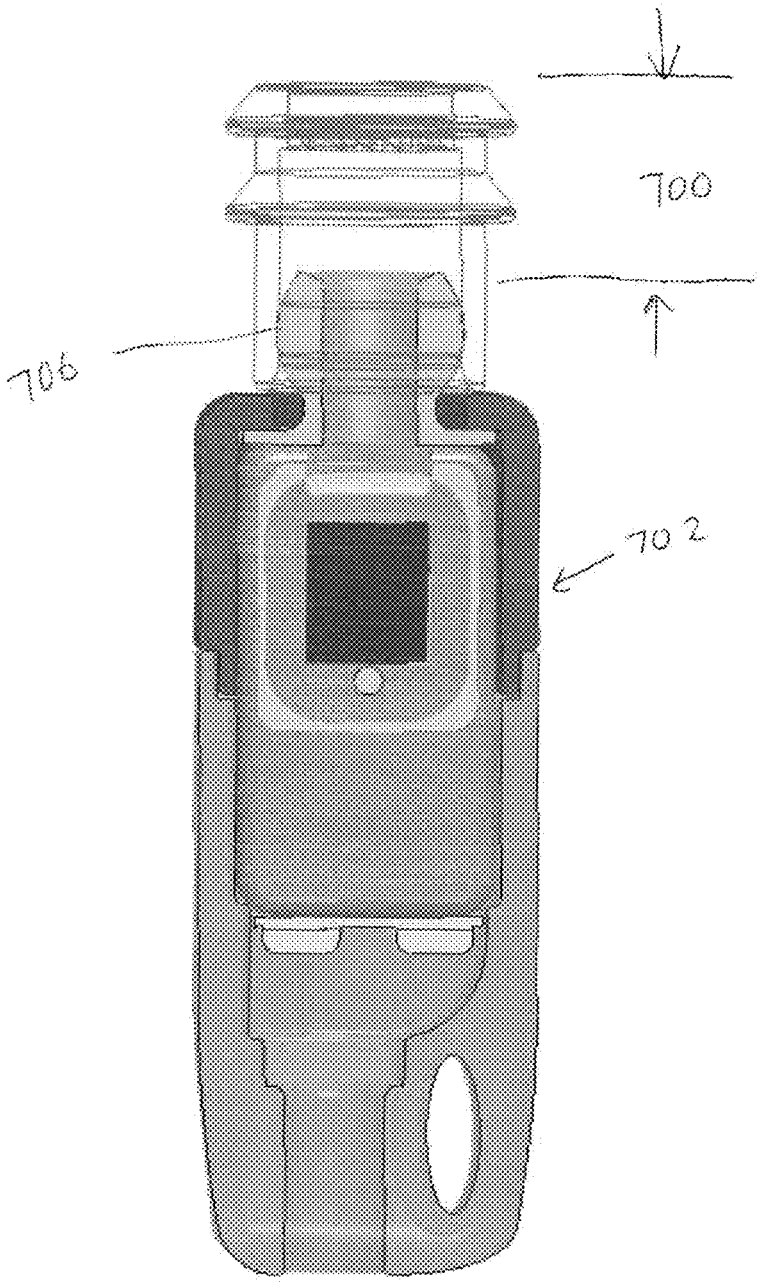
FIG. 7 illustrates an apparatus including a ball and socket snap spout for a custom hearing assistance device, according to various embodiments of the present subject matter.

FIG. 7 illustrates an apparatus including a ball and socket snap spout for a custom hearing assistance device, according to various embodiments of the present subject matter. A receiver case 702 including a spherical spout 706 configured for a ball and socket connection is shown. The depicted embodiment provides an insertion length reduction 700 of the housing assembly. In one embodiment, the insertion length of the housing assembly is reduced by approximately 2 millimeters. Other reduction amounts are possible without departing from the scope of the present subject matter.

The present subject matter provides many benefits, including providing a sealing element to enhance output, controlling port geometry for reliable response shape, and providing a universal quick connector to allow use in custom and stock applications. Further benefits include providing a sealing socket enabling utilization of higher gain receivers while minimizing acoustic leakage. In addition, the utility of the snap design affords quick and easy replacement of components requiring service while retaining the still functioning components. This should minimize the time the patient is without a hearing device.

According to various embodiments, a receiver spout is configured as to enable a quick connect and disconnect at various degrees on and off vertical axial alignment with repeatable reliability. The acoustic opening in the spout is encompassed by a radial concave contour, in various embodiments. This acts as a seal receptacle to allow the use of higher gain receivers while limiting acoustic leakage back into the receiver cavity thereby directing all amplification into the ear canal. In various embodiments, the receptacle housing is manufactured as to allow an elastomeric component to be molded or bonded inside the receptacle housing. The elastomeric component has a convex shape that complements the concave seal feature in the spout that upon insertion of the spout establishes a retained interference thereby creating an acoustic seal element, in various embodiments. The receptacle housing is designed to feature interfaces for industry standard elastomeric buds and wax protection devices, in various embodiments. This housing may or may not feature an elastomeric seal as its purpose is to provide a barrier between the ear canal and the metallic components of the receiver, act as a retainer and receptacle for separate replaceable standard ear buds at a fixed distance so as to ensure a proper and repeatable response from the receiver, and/or act as a retainer and receptacle for separate replaceable wax protection device. The convex insert and concave opening afford variations in range of motion and in angular alignment of the ball and socket while maintaining the acoustic seal.

Modern hearing instruments include a housing or shell with internal components such as a signal processor, a microphone and a receiver housed in a receiver case. The signal processor includes, but is not limited to, a digital signal processor (DSP), a microprocessor, and a microcontroller. Various memory devices including volatile and non-volatile memory can be used. The housing or shell of a hearing assistance device has a size limitation based on the application. Specifically, devices that include an in-the-ear portion have housings that are constrained by the geometry of the inner ear of the wearer. Constraints for the device housing or shell generally include a relatively small size (miniaturization), sharp bends and a rounded shape. Receiver cases currently have a cylindrical receiver spout that connects to a sound tube within the hearing assistance device housing. Once engaged, the cylindrical receiver spout does not allow significant movement of the receiver case with respect to the sound tube, which prevents a proper fit into the curved volumes of hearing assistance device housings or shells. In addition, improper fit can cause feedback where a receiver case is forced into contact with the curved interior surface of a device housing or shell.

Disclosed herein, among other things, are apparatus and methods to provide improved connections for components of hearing assistance devices. In various embodiments, a hearing assistance device includes a housing having a receiver case and a sound tube within the housing. The receiver case includes a spherical receiver spout, and the sound tube is adapted to mate with the spherical receiver spout to form a ball and socket connection. After the receiver spout is mated with the sound tube, the receiver case is configured to be oriented at a desired angle with respect to the sound tube to conform to an inner surface of the housing, in various embodiments.

The present subject matter provides smaller custom device sizes for in-the-ear (ITE), in-the-canal (ITC), completely-in-the-canal (CIC), or invisible-in-canal (IIC) type hearing devices. In addition, the present subject matter provides smaller standard device sizes for BTE, or receiver-in-the-canal (RIC) type devices. Further, the present subject matter provides smaller device sizes for AMP (personal audio amplifier) deep insertion devices, whether custom or standard.

FIG. 1 illustrates a receiver case 102 and sound tube 104 for a hearing assistance device, according to one embodiment of the present subject matter. The receiver case 102 includes a spherical receiver spout 106, and the sound tube 104 is adapted to mate with the spherical receiver spout 106 to form a ball and socket connection 110.

Figure 2:
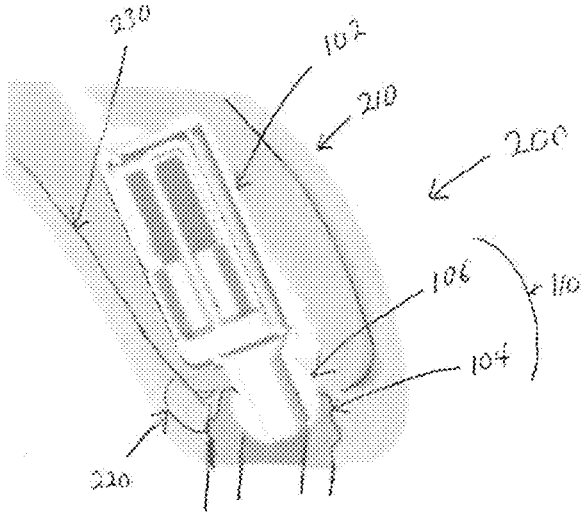
FIG. 2 illustrates a cross-section of a hearing assistance device, according to one embodiment of the present subject matter.

FIG. 2 illustrates a cross-section of a hearing assistance device 200, according to one embodiment of the present subject matter. The depicted hearing assistance device includes a completely-in-the-canal (CIC) device, in an embodiment. The hearing assistance device 200 includes a housing 210 having a receiver case 102 and a sound tube 104 within the housing 210. The receiver case 102 includes a spherical receiver spout 106, and the sound tube 104 is adapted to mate with the spherical receiver spout 106 to form a ball and socket connection 110. After the receiver spout 106 is mated with the sound tube 104, the receiver case 102 is configured to be oriented at a desired angle 220 with respect to the sound tube 104 to conform to an inner surface 230 of the housing, in various embodiments. This shows how a ball-socket connection can be used to tilt the receiver body away from the shell walls, while maintaining a desirable acoustic path for receiver sound. FIG. 2 depicts a CIC hearing aid. CIC hearing aids are only one type of hearing assistance device. It is understood that their use in the description is intended to demonstrate the present subject matter, but not in a limited or exclusive or exhaustive sense. Other hearing assistance devices include, but are not limited to, those in this document.

In various embodiments, the hearing assistance device includes a digital hearing assistance device. The digital hearing assistance device includes a housing, a digital signal processor within the housing, and a receiver case within the housing, in various embodiments. The receiver case includes a spherical receiver spout and includes a hearing assistance device receiver, the receiver configured to be connected to the digital signal processor and further configured to play sound processed by the digital signal processor, in various embodiments. Various embodiments of the digital hearing assistance device further include a microphone and an acoustic feedback canceller within the housing.

In custom applications, the present subject matter is beneficial for, among other things, positioning a receiver case deep in a canal tip of a custom hearing aid shell, where an extremely sharp bend of the sound path is required. This allows other components of the hearing aid to be packaged more efficiently and thus reduces the overall size of the hearing aid. In addition, the present subject matter reduces or eliminates mechanical feed back. In various embodiments, the present subject matter reduces or eliminates the need for tube sealant at the junction of the sound tube and the receiver spout. According to various embodiments, the present subject matter employs a universally-shaped short sound tube. According to an embodiment, the sound tube snaps in to the sound hole of a hearing aid shell, such as an ITE shell. The sound tube is glued in to the sound hole, in an embodiment. Once engaged, the receiver position can be oriented in a variety of angles with respect to the sound tube (and with respect to the sound hole in the shell) to fit the shape of the cavity of the shell canal or inner housing. This minimizes contact of the receiver case with the shell, and thereby minimizes transmission of mechanical vibration witch can cause feedback in the device. According to various embodiments, the sound tube includes a cylindrically-shaped tube molded from elastomers for the desired properties of ball-socket retention and transmission of vibration. Other materials can be used for the sound tube without departing from the scope of the disclosure. The present subject matter can be manufactured by modifying the receiver spout design and creating molded elastomer universal sound tubes, in various embodiments.

It is further understood that any hearing assistance device may be used without departing from the scope and the devices depicted in the figures are intended to demonstrate the subject matter, but not in a limited, exhaustive, or exclusive sense. It is also understood that the present subject matter can be used with a device designed for use in the right ear or the left ear or both ears of the wearer.

The present subject matter can be used for a variety of hearing assistance devices, including but not limited to, assistive listening devices, tinnitus masking devices, cochlear implant type hearing devices, hearing aids, such as behind-the-ear (BTE), in-the-ear (ITE), in-the-canal (ITC), or completely-in-the-canal (CIC) type hearing aids. It is understood that behind-the-ear type hearing aids may include devices that reside substantially behind the ear or over the ear. Such devices may include hearing aids with receivers associated with the electronics portion of the behind-the-ear device, or hearing aids of the type having receivers in the ear canal of the user, such as receiver-in-the-canal (RIC) or receiver-in-the-ear (RITE) designs. It is understood that other hearing assistance devices not expressly stated herein may fall within the scope of the present subject matter.

This application is intended to cover adaptations or variations of the present subject matter. It is to be understood that the above description is intended to be illustrative, and not restrictive. The scope of the present subject matter should be determined with reference to the appended claims, along with the full scope of legal equivalents to which such claims are entitled.

What is claimed is:

1. A receiver housing configured to house a hearing device receiver, the receiver housing comprising:

a spherical receiver spout including an opening configured to mate and form a ball and socket connection with a spherical socket of an interface to a hearing device, the spherical socket including a removable solid insert recessed within the socket, a lip of the insert configured to establish a retained interference fit with a lip of the opening of the receiver spout when the connection is formed so as to create an acoustic seal therebetween.

2. The receiver housing of claim 1, wherein the housing includes an injection molded housing.

3. The receiver housing of claim 1, wherein the housing includes a custom cast ear canal impression.

4. The receiver housing of claim 1, wherein the interface includes a mounting sleeve.

5. The receiver housing of claim 4, wherein the mounting sleeve is configured to hold an ear bud.

6. The receiver housing of claim 1, wherein the interface includes a snap interface to a custom hearing device shell.

7. The receiver housing of claim 1, wherein the hearing device includes a cochlear implant.

8. The receiver housing of claim 1, wherein the hearing device includes a hearing aid.

9. The receiver housing of claim 8, wherein the hearing aid includes a behind-the-ear (BTE) hearing aid.

10. The receiver housing of claim 8, wherein the hearing aid includes an in-the-ear (ITE) hearing aid.

11. The receiver housing of claim 8, wherein the hearing aid includes an in-the-canal (ITC) hearing aid.

12. The receiver housing of claim 8, wherein the hearing aid includes a completely-in-the-canal (CIC) hearing aid.

13. The receiver housing of claim 8, wherein the hearing aid includes a receiver-in-the-canal (RIC) hearing aid.

14. The receiver housing of claim 8, wherein the hearing aid includes a receiver-in-the-ear (RITE) hearing aid.

15. A system, comprising:

a receiver case configured to house a hearing device receiver, the receiver case including a spherical receiver spout, the spherical receiver spout including an opening; and a receptacle housing including a spherical socket adapted to mate with the spherical receiver spout to form a ball and socket connection, and including a removable solid retention feature recessed within the socket, a lip of the insert configured to establish a snap fit with an adjustable retention force to a lip of the opening of the receiver spout when the connection is formed so as to create an acoustic seal therebetween.

16. The system of claim 15, wherein the receptacle housing is configured to hold an ear bud.

17. The system of claim 15, wherein the retention feature is configured to provide an adjustable retention force by changing a degree of undercut of the retention feature.

18. The system of claim 17, wherein the retention feature is configured to be adjusted to use as a one-time snap connection.

19. The system of claim 17, wherein the retention feature is configured to be adjusted to use as a multiple snap connection.

20. The system of claim 15, wherein the receptacle housing is configured to connect the receiver case to a behind-the-ear (BTE) hearing aid, an in-the-ear (ITE) hearing aid, an in-the-canal (ITC) hearing aid, a completely-in-the-canal (CIC) hearing aid, a receiver-in-the-canal (RIC) hearing aid or a receiver-in-the-ear (RITE) hearing aid.

* * * * *